United States Patent [19]

Eriksson et al.

[11] Patent Number: 4,921,650

[45] Date of Patent: May 1, 1990

[54] METHOD AND APPARATUS FOR LIQUID TREATMENT OF PULP

[75] Inventors: Kjell G. Eriksson, Spanga; Bo R. Ek, Stockholm; Stig G. Wallin, Alnö; Nils L. Eriksson, Sundsvall, all of Sweden

[73] Assignee: Sunds Defibrator Aktiebolag, Sweden

[21] Appl. No.: 85,630

[22] PCT Filed: Nov. 13, 1986

[86] PCT No.: PCT/SE86/00521

§ 371 Date: Jul. 16, 1987

§ 102(e) Date: Jul. 16, 1987

[87] PCT Pub. No.: WO87/03626

PCT Pub. Date: Jun. 18, 1987

[30] Foreign Application Priority Data

Dec. 13, 1985 [SE] Sweden ..... 8505918

[51] Int. Cl.[5] ..... D01G 7/00; D01G 21/00; D04H 1/00

[52] U.S. Cl. ..... 264/37; 241/18; 241/19; 241/28; 264/115; 264/116; 264/121; 264/518; 425/83.1; 425/197; 425/217

[58] Field of Search ..... 425/83.1, 197, 217; 264/121, 518, 37, 115, 116, 517; 241/18, 19, 28; 19/303, 304, 305

[56] References Cited

U.S. PATENT DOCUMENTS 2,845,661 8/1958 Sverde et al. ..... 425/83.1

3,482,287 12/1969 Flewwelling ..... 264/121

*Primary Examiner*—Hubert C. Lorin

*Attorney, Agent, or Firm*—Lerner, David, Littenberg, Krumholz & Montlik

[57] ABSTRACT

Fibre material is defibrated and dispersed in an air flow and introduced through an inlet (2) into a forming head (1). In the forming head (1) the inlet transforms to a single-curved convex surface (5), which leads all the way to an accept outlet (6). A screen (7) is located at adjustable distance from the curved surface (5) for dividing ingoing fibre/air flow into accept and reject. An outlet (10) for the reject is located behind the screen (7). At a distance of 10–150 mm from the accept outlet (6) a running air-pervious support (27) is located, on which the web precipitates.

15 Claims, 3 Drawing Sheets

METHOD AND APPARATUS FOR LIQUID TREATMENT OF PULP

BACKGROUND OF THE INVENTION

This invention relates to the dry forming of webs.

Dry forming implies that the fibre material dispersed in air is caused to flow against a running forming wire. The fibres precipitate on the wire while the air passes therethrough. In commercially available plants for dry forming, the web is formed by using nets or screen plates, through which the fibres are to pass prior to their precipitation on the wire. The finer the net, the cleaner the web, but at the same time the fibre flow is reduced and an ever increasing amount of fibres are separated as reject and recycled for repeated defibration. The result is low capacity and degradation of the fibres. A further disadvantage is that the fibres easily can clog the holes in the net or screen and thereby cause non-uniform fibre distribution.

SUMMARY OF THE INVENTION

The present invention relates to a method and device for forming a web where the aforesaid disadvantages are eliminated. According to the invention, no nets or screen plates are used in connection with the forming, but undefibrated fibres are separated at a previous stage, and the distribution of the fibre material on the forming wire is brought about in that the fibre dispersion on its path to the forming wire is caused to flow along a curved surface. The characterizing features of the invention become apparent in greater detail in the claims.

BRIEF DESCRIPTION OF THE DRAWINGS

The invention is described in greater detail in the following by way of an embodiment thereof and with reference to the accompanying drawings.

DESCRIPTION OF THE INVENTION

Figure 1:
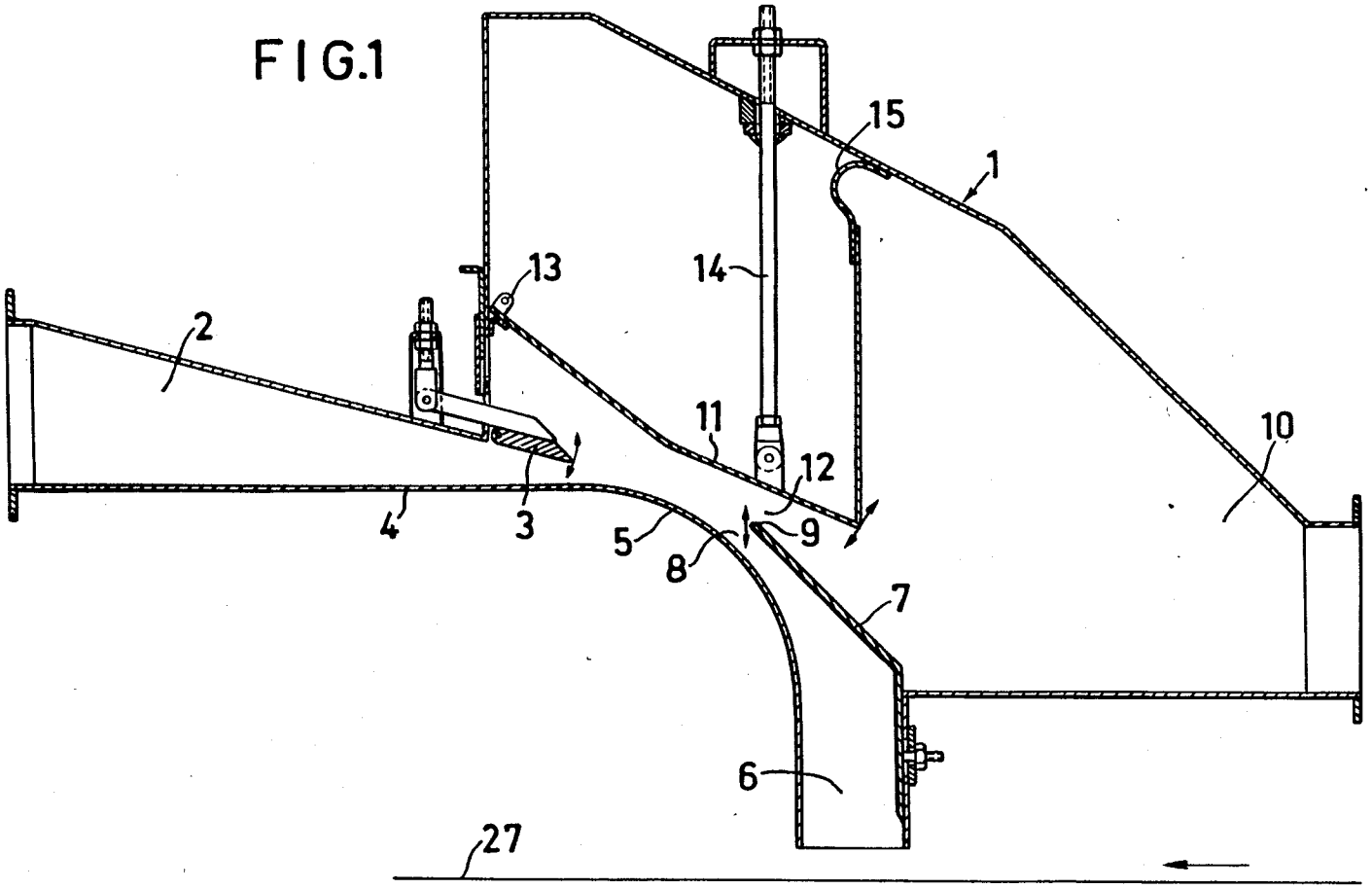
FIG. 1 shows a forming head according to the invention.

The forming head 1 is provided with an inlet 2, which is designed so as to have successively decreasing height and increasing width, The cross-section of the inlet 2, thus, can transform from circular to rectangular. The final height of the inlet 2 is adjustable by means of a swing lip 3, which co-operates with the stationary lower wall 4 of the inlet. The lip 3 can be divided into individually adjustable sections for controlling the final height of the inlet 2 in the transverse direction and thereby controlling the transverse profile of the web. After the lip 3, the wall 4 transforms to a continuous single-curved convex surface 5. the radius of which must exceed 100 mm. This curved surface 5 leads to an accept outlet 6, which is so directed downwards that it forms an angle of about 90° inlet 2. Other angles between 45° and 180°, however, can also be used.

A screen 7 is located spaced from the curved surface 5 and extends along the entire width of the inlet, thereby forming a passage 8 between the screen 7 and curved surface 5. The narrowest section of the passage is defined by the leading edge 9 of the screen which is located after about half of the curved surface 5. The screen 7 being movable, the distance between the leading edge of the screen and the curved surface 5 can be varied. The screen 7 is substantially in parallel with a tangent to the curved surface 5 in a point directly in front of the edge 9. The screen 7 delimits the accept outlet 6 from a reject outlet 10.

Above the screen 7 an adjustable wall 11 is located, which together with the edge 9 of the screen defines a passage 12 above the screen 7. This passage 12 communicates with the reject outlet 10. The wall 11 is pivotal about a hinge 15 by means of an adjustable stay member 4. The wall 11 further is sealed against the upper portion of the forming head 1 by a sealing 15, thereby preventing return flow of the reject in the forming head.

The fibre material is supplied to the forming head in the form of fibres dispersed in air. The flow rate in the narrowest section of the inlet must exceed 100 m/sec. Hereby the fibres are dispersed which may have entangled (fibre fluff pieces). The incoming fibre/air flow deflects along the curved surface 5, which should be relatively rough so that the flow follows the surface without forming turbulence or give rise to other disturbances. The screen 7 divides the flow so that part of it containing the coarsest particles flows through the reject passage 12 while the remainder flows through the accept passage 8. The distribution between accept and reject can be determined by moving the screen 7. The distribution should be such that the accept flow is 25–75% of the incoming flow. The wall 11 prevents return flow of the reject in the forming head 1.

The accept is allowed to flow out through the accept outlet 6 down to a running air-pervious support, preferably in the form of a wire. The opening of the accept outlet to the wire should be 50–300 mm, calculated in the direction of movement of the wire. The width should be substantially equal to the width of the inlet 2. It is essential, however, that the fibre/air flow is laterally defined by walls all the distance from the inlet 2 to the accept outlet 6. On the lower surface of the wire a suction box can be located. The wire speed should be 50–1000 m/min, preferably 100–200 m/min. The accept outlet 6 should be located at a distance of 10–150 mm from the wire. As the web is being built up on the wire, the air perviousness of the wire decreases, thereby giving rise to a counterpressure in the accept outlet 6 and accept passage 8. Due to this counterpressure, the incoming fibre/air flow automatically is displaced to the reject passage 12, because the capability of the flow to follow the curved surface depends on the counterpressure in the accept flow. This means that upon increase of the web thickness on the wire the fibre supply decreases, and upon decrease of the web thickness the fibre supply increases. Thereby a web with a very uniform web thickness (grammage) can be obtained. This web thickness is maintained automatically in the way described above. Grammage variations, thus, can be kept within 5%.

Figure 2:
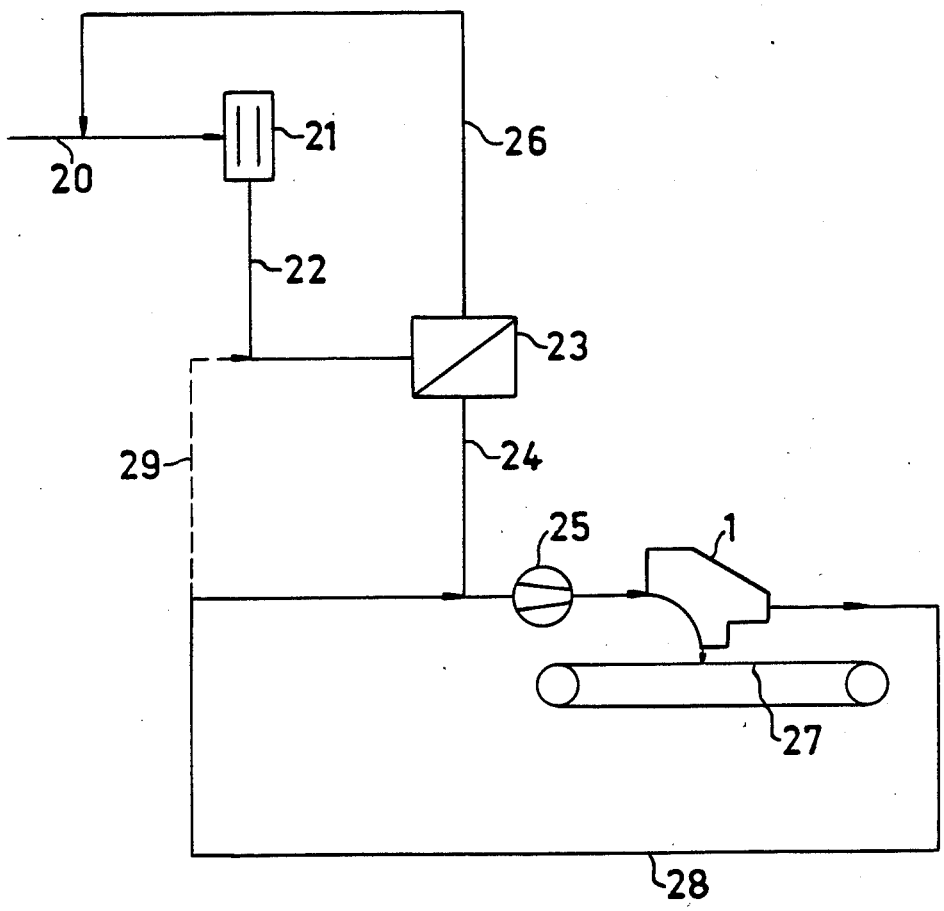
FIG. 2 is a basic flow diagram for a plant according to the invention.

In FIG. 2 a basic flow diagram for an embodiment is shown. Fibre material is charged through a conduit 20 to a refiner 21 for defibration. The defibrated material is transferred through a conduit 22 to a screen 23. A conduit 24 from the accept side of the screen leads via a fan 25 to the forming head 1. The reject from the screen 23 is led via a conduit 26 to repeated defibration.

In the forming head the flow is divided into accept, which is precipitated on a running support 27, and reject, which via a conduit 28 entirely or partially is returned to the forming head 1. Part of the reject possibly can be returned via a conduit 29 for repeated screening in the screen 23.

The screen 23 can represent several single screens which, for example, can be cascade connected in a closed air circuit. An additional refiner can also be provided for reject refining. By carrying out a defibration as complete as possible of the material prior to its advancing to the forming head 1, the flow in the forming loop can be closed, i.e. all fibre material from the conduit 28 is returned to the forming head 1. Hereby the forming head is utilized exclusively for bringing about a web with uniform grammage, as described above.

Alternatively, part of the reject from the conduit 28 can be separated for repeated screening and re-defibration. The forming head 1 hereby also acts as a screen for separating coarse particles.

Figure 3:
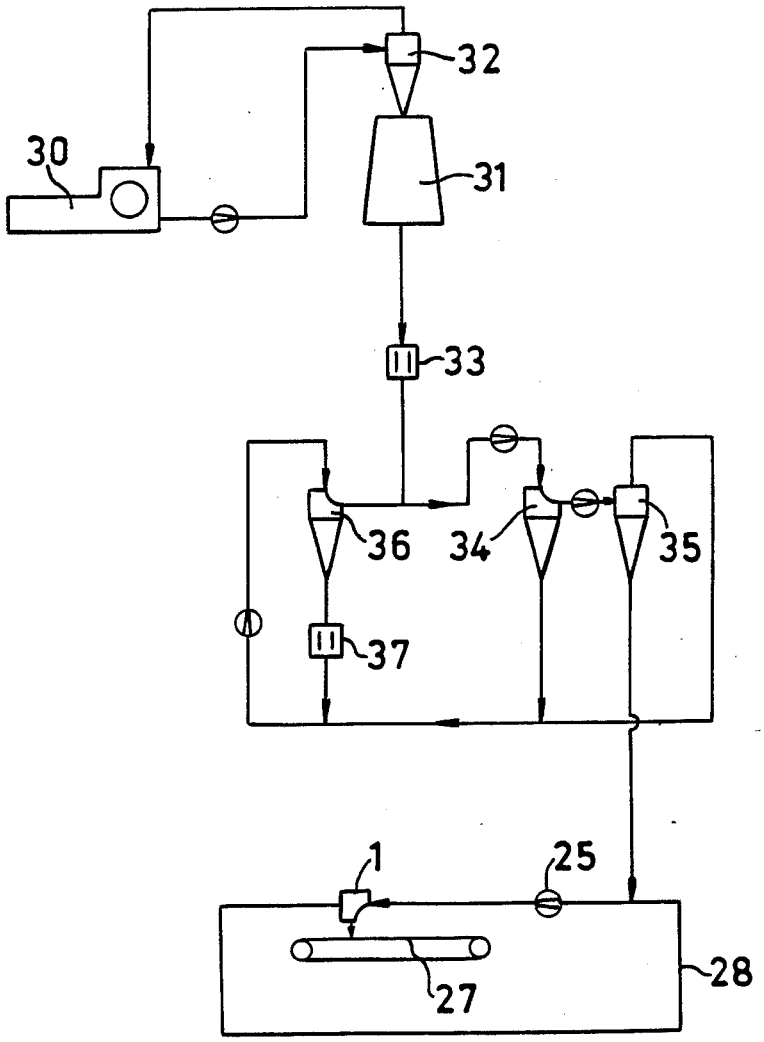
FIG. 3 is a flow diagram for a preferred embodiment.

In FIG. 3 a preferred embodiment is shown. According to this embodiment, the fibre material is supplied in the form of bales to a bale shredder 50, from which the material is blown to a container 31. The air is separated in a cyclone 32. Thereafter fine shredding is carried out in a refiner 33, from which the fibres are blown to a screen 34. The accept from this screen 34 is transferred via a cyclone 35 to the forming loop, which comprises a fan 25, a forming head 1, a forming support 27 and a reject conduit 28. The reject from the screen 34 is led to a second screen 36 where the reject is led to a reject refiner 37 for defibration while the accept is returned to the screen 34.

This arrangement implies that the forming loop is closed, i.e. all material allowed to enter the loop sooner or later will come out on the support 27.

EXAMPLE

At the embodiment according to FIG. 3 the operation conditions were as follows:

| | |
|---|---|
| Radius of the curved surface (5) | 200 mm |
| Distance between the screen (7) and curved surface (5) | 25 mm |
| Distance between the outlet (6) and wire (27) | 110 mm |
| Air speed in the narrowest portion of inlet (2) | 144 m/s |
| Reject amount | 60% |

The following mechanical properties of a web of bleached sulphate pulp could be noted:

| | |
|---|---|
| Web strength in machine direction | 0,4 N/15 mm width |
| Web strength transverse to machine direction | 0,3 N/15 mm width |
| Density | 22 kg/m$^3$ |
| Profile deviation in machine direction | ±3% |
| Profile deviation transverse to machine direction | ±3,3% |
| Grammage | 176 g/m$^2$ |

The web obtained, thus, was very uniform. Of particular importance is the uniformity in strength along and transverse to machine direction.

The invention, of course, is not restricted to the embodiment described, but can be varied within the scope of the invention idea.

We claim:

1. A method of dry forming a fibrous web of fibrous material having a substantially uniform thickness, comprising the steps of, defibration of said fibrous material, dispersion of said defibrated fibrous material in a flow of air so that said defibrated fibrous material is carried by said flow of air, deflecting said flow of air carrying said defibrated fibrous material along a convex surface so as to subject said defibrated fibrous material to centrifugal forces and shearing gradients and thereby vary the degree of deflection of different portions of said defibrated fibrous material, separating said deflected flow of air carrying fibrous material into a first portion and second portion, said first portion having a lower degree of deflection than said second portion and being at a first predetermined pressure, said first portion comprising a reject flow portion, and said second portion being at a second predetermined pressure, said second portion comprising an accept flow portion, depositing said accept flow portion on an air-pervious support to form a fibrous web on said support, said second predetermined pressure being independent upon the thickness of said fibrous web on said air-pervious support, whereby as said thickness of said fibrous web increases said second predetermined pressure increases, thereby increasing said first portion of said deflected flow of air-carrying fibrous material and concomitantly reducing said second portion of said defibrated flow of air carrying fibrous material, and providing a substantially uniform thickness for said fibrous web on said support.

2. The method of claim 1 wherein said dispersion of said defibrated fibrous material in said flow of air comprises providing said fibrous material carried by said flow of air at a speed of greater than about 100 meters/-sec.

3. The method of claim 1 wherein said deflecting of said air flow along said convex surface deflects said air flow from between 45° and 180°.

4. The method of claim 1, including recycling said reject flow portion in a closed flow loop to said deflecting step.

5. The method of claim 1, wherein said convex surface is rough.

6. The method of claim 1, wherein said flow of air carrying said defibrated fibrous material has a width corresponding substantially to the width of said fibrous web.

7. The method according to claim 1, wherein said accept flow portion comprises between 25% and 75% of said flow of air carrying said defibrated fibrous material.

8. The method of claim 1, including supplying said fibrous material in the form of a bales, shredding said bales of said fibrous material and blowing said shredded bales of said fibrous material through a screen prior to said defibration step.

9. A device for dry forming a web of fibrous material having a uniform thickness comprising, a forming head having an interior and inlet means for delivering a flow of air carrying said fibrous material to said interior, a convex surface for deflecting said flow of air carrying said fibrous material so as to subject said fibrous material to centrifugal forces and shearing gradients and thereby vary the degree of deflection of different portions of said fibrous material, separating means for separating said deflected flow of air carrying said fibrous material into a first portion and a second portion, said separating means comprising a separating screen having a leading edge which is located beyond the crest of said convex surface in the direction of said flow, said first portion having a lower degree of deflection than said second portion, said first portion comprising a reject flow portion having a first predetermined pressure, and said second portion comprising an accept flow portion having a second predetermined pressure, a reject outlet for receiving said reject flow portion, an adjustable wall member, said reject outlet being defined by said adjustable wall member and said separating screen whereby distribution between accept and reject flows can be adjusted, an accept outlet for receiving said accept flow portion, and an air-pervious support cooperatively situated relative to said accept outlet for receiving said accept flow portion from said accept outlet so as to provide said web of fibrous material on said air-pervious support, said second predetermined pressure being dependent upon the thickness of said web of fibrous material on said air-pervious support, whereby as said thickness of said fibrous web increases said second predetermined pressure increases, thereby increasing said first portion of said deflected flow of air carrying said fibrous material and concomitantly reducing said second portion of said deflected flow of air carrying said fibrous material, and providing a uniform thickness for said fibrous web on said support.

10. The device in claim 9, wherein said convex surface deflects said flow by an angle of about ninety degrees.

11. The device in claim 9, wherein said inlet means is adjustable to control the flow of air carrying said fibrous material.

12. The device in claim 9, wherein said accept outlet is located at a distance between 10 and 150 millimeters from said air-pervious support.

13. The device in claim 9, wherein said convex surface is rough.

14. The device in claim 9, including defribration means for defibrating said fibrous material.

15. The device in claim 9, including shredding means for shredding a bale of fibrous material and blowing means for blowing said shredded fibrous material through a screen prior to defibration.

* * * * *

UNITED STATES PATENT AND TRADEMARK OFFICE

CERTIFICATE OF CORRECTION

PATENT NO. : 4,921,650

DATED : May 1, 1990

INVENTOR(S) : Kjell G. Eriksson, Bo R. Ed, Stig G. Wallin, Nils L. Erikkson

It is certified that error appears in the above-identified patent and that said Letters Patent is hereby corrected as shown below:

Column 1, line 59, following "90°" insert --with the--.

Column 2, line 9, delete "15" and substitute therefor --13--.

Column 2, line 10, delete "4" and substitute therefor --14--.

Column 3, line 19, delete "50" and substitute therefor --30--.

Column 4, line 15, delete "independent" and substitute therefor --dependent--.

Signed and Sealed this

Tenth Day of December, 1991

*Attest:*

HARRY F. MANBECK, JR.

*Attesting Officer*

*Commissioner of Patents and Trademarks*